US011525618B2

(12) United States Patent
Elsherbini et al.

(10) Patent No.: US 11,525,618 B2
(45) Date of Patent: Dec. 13, 2022

(54) ENHANCED HEAT EXCHANGER PERFORMANCE UNDER FROSTING CONDITIONS

(71) Applicant: Hamilton Sundstrand Corporation, Charlotte, NC (US)

(72) Inventors: Abdelrahman I. Elsherbini, Windsor, CT (US); Abbas A. Alahyari, Glastonbury, CT (US); Yinshan Feng, Manchester, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 312 days.

(21) Appl. No.: 16/592,915

(22) Filed: Oct. 4, 2019

(65) Prior Publication Data

US 2021/0102743 A1 Apr. 8, 2021

(51) Int. Cl.

| | |
|---|---|
| ***F25D 21/12*** | (2006.01) |
| ***F28F 1/12*** | (2006.01) |
| ***F28F 9/02*** | (2006.01) |

(52) U.S. Cl.

CPC ..... *F25D 21/12* (2013.01); *F28F 1/126* (2013.01); *F28F 9/02* (2013.01)

(58) Field of Classification Search

CPC ..... F25D 21/12; F28D 1/05366; F28F 1/126; F28F 9/02; F28F 2215/04; F28F 1/128; F28F 2210/08; F28F 2260/02; F28F 1/022; F28F 1/40; F28F 13/12; F28F 1/025

USPC ..... 165/61

See application file for complete search history.

(56) References Cited

U.S. PATENT DOCUMENTS 4,570,700 A * 2/1986 Ohara ..... F25B 39/02 165/134.1
5,174,373 A * 12/1992 Shinmura ..... F28D 1/05391 165/146
5,915,469 A 6/1999 Abramzon et al.
6,435,268 B1 8/2002 Bhatti et al.

(Continued)

FOREIGN PATENT DOCUMENTS

DE 102005052683 A1 5/2007
DE 102007031824 A1 3/2008

(Continued)

OTHER PUBLICATIONS

Extended European Search Report dated Jul. 15, 2020, received for corresponding European Application No. 19216011.7, 8 pages.

*Primary Examiner* — Len Tran
*Assistant Examiner* — Gustavo A Hincapie Serna
(74) *Attorney, Agent, or Firm* — Kinney & Lange, P. A.

(57) ABSTRACT

A nonlinear coolant tube adapted for use in a heat exchanger core that is configured to port a hot fluid therethrough and a cold fluid therethrough while maintaining isolation of the hot fluid from the cold fluid, and including a hot circuit defining a hot circuit inlet, a hot circuit outlet, a first edge, and a second edge, the first edge distal the second edge, the first edge proximate the hot circuit inlet and the second edge proximate the hot circuit outlet. The nonlinear coolant tube is configured to provide a non-uniform heat transfer profile between the hot fluid and the cold fluid from the first edge to the second edge, such that a thermal resistance of the nonlinear coolant tube near the first edge is greater than the thermal resistance of the nonlinear coolant tube near the second edge.

18 Claims, 9 Drawing Sheets

(56) References Cited

U.S. PATENT DOCUMENTS

| | | | | |
|---|---|---|---|---|
| 7,942,020 | B2 | 5/2011 | Knight et al. | |
| 8,661,676 | B2 | 3/2014 | McNulty | |
| 8,776,874 | B2 * | 7/2014 | Hu | F28F 1/022 165/178 |
| 9,777,964 | B2 * | 10/2017 | Taras | F28D 7/16 |
| 2001/0004014 | A1 * | 6/2001 | Dienhart | F28F 1/022 165/177 |
| 2002/0066554 | A1 * | 6/2002 | Oh | F28F 1/022 165/179 |
| 2003/0209344 | A1 * | 11/2003 | Fang | F28D 1/05391 165/140 |
| 2004/0035562 | A1 * | 2/2004 | Nishijima | F28F 13/06 165/133 |
| 2005/0051317 | A1 * | 3/2005 | Chin | F28F 1/022 165/177 |
| 2006/0016583 | A1 * | 1/2006 | Kaspar | F25B 39/04 165/110 |
| 2007/0096611 | A1 * | 5/2007 | Antonijevic | F16L 9/19 313/46 |
| 2008/0185130 | A1 * | 8/2008 | Fang | F28D 1/05383 165/177 |
| 2009/0166016 | A1 * | 7/2009 | Hu | F28D 1/0443 165/151 |
| 2010/0006276 | A1 * | 1/2010 | Cremaschi | B21D 53/085 165/173 |
| 2010/0012307 | A1 * | 1/2010 | Taras | F28F 1/126 165/181 |
| 2010/0089546 | A1 * | 4/2010 | Perez | F28D 1/05383 165/41 |
| 2012/0267088 | A1 * | 10/2012 | Lange | F28D 15/0233 165/181 |
| 2015/0285567 | A1 * | 10/2015 | Hokazono | B23P 15/26 165/181 |
| 2017/0263847 | A1 | 9/2017 | Daoust et al. | |
| 2017/0284749 | A1 | 10/2017 | Smith et al. | |
| 2017/0343288 | A1 | 11/2017 | Joardar | |
| 2017/0356690 | A1 * | 12/2017 | Nakamura | F28F 21/06 |
| 2018/0164045 | A1 | 6/2018 | Alahyari et al. | |
| 2018/0313610 | A1 * | 11/2018 | Fukada | F28D 1/05366 |
| 2019/0032975 | A1 * | 1/2019 | Hancock | F25B 49/02 |
| 2020/0018494 | A1 * | 1/2020 | Yatsuyanagi | F28F 1/32 |
| 2020/0088470 | A1 * | 3/2020 | Yamamoto | F28F 1/022 |

FOREIGN PATENT DOCUMENTS

| | | | |
|---|---|---|---|
| EP | 2159514 | A2 | 3/2010 |
| JP | 58200997 | A | 11/1983 |
| WO | 2008064199 | A1 | 5/2008 |

* cited by examiner

ENHANCED HEAT EXCHANGER PERFORMANCE UNDER FROSTING CONDITIONS

BACKGROUND

The present disclosure relates to heat exchangers, and more particularly, to a heat exchanger design that improves the heat exchanger performance under frosting conditions.

Heat exchangers are known in the aviation art and in other industries for providing a means of exchanging heat from a hot fluid to a cold fluid. In a particular application, the hot fluid is air and the cold fluid is a coolant or refrigerant that cools the air passing through the heat exchanger. When moisture (i.e., water vapor, humidity) is in the air, water can condense on the cooler heat exchanger surfaces. When the cold fluid (i.e., coolant) is at a temperature below the freezing point of water, frosting can occur (i.e., ice forms) on the heat exchanger surfaces. Frosting (i.e., ice formation) generally occurs in the region of the heat exchanger where the hot moist fluid enters the heat exchanger. The ice accumulation can impede the performance of the heat exchanger, thereby requiring a periodic defrost cycle that melts the ice. Frequent frosting and subsequent defrost cycles can interrupt the primary purpose of the heat exchanger, that being the cooling of incoming air.

Heat exchanger designs that attempt to reduce the rate of frosting are known in the art, with examples including complex flow paths for the incoming air (i.e., hot working fluid), for the coolant (i.e., cold working fluid), or for both. While being suitable for large heat exchangers that can be accommodated in a large installation envelope, those designs are disadvantageous for compact heat exchangers, including those that are installed in a fairly compact working space (i.e., installation envelope). Accordingly, there is need for a robust heat exchanger design that can reduce frosting while not requiring complicated flow paths of the hot and/or cold working fluids.

SUMMARY

A nonlinear coolant tube adapted for use in a heat exchanger core that is configured to port a hot fluid therethrough and a cold fluid therethrough while maintaining isolation of the hot fluid from the cold fluid, and including a hot circuit defining a hot circuit inlet, a hot circuit outlet, a first edge, and a second edge, the first edge distal the second edge, the first edge proximate the hot circuit inlet and the second edge proximate the hot circuit outlet. The nonlinear coolant tube is configured to provide a non-uniform heat transfer profile between the hot fluid and the cold fluid from the first edge to the second edge, such that a thermal resistance of the nonlinear coolant tube near the first edge is greater than the thermal resistance of the nonlinear coolant tube near the second edge.

A method of reducing frost accumulation in a hot circuit of a heat exchanger core that includes a hot circuit and a cold circuit, the heat exchanger core configured to port a hot fluid therethrough and a cold fluid therethrough while maintaining isolation of the hot fluid from the cold fluid, the hot circuit defining a hot circuit inlet, a hot circuit outlet, a first edge, and a second edge, the first edge distal the second edge, the first edge proximate the hot circuit inlet and the second edge proximate the hot circuit outlet includes configuring the cold circuit to include a nonlinear coolant tube that provides a non-uniform heat transfer profile between the hot fluid and the cold fluid from the first edge to the second edge, such that a thermal resistance of the nonlinear coolant tube near the first edge is greater than the thermal resistance of the nonlinear coolant tube near the second edge.

DETAILED DESCRIPTION

The present disclosure is directed to providing a non-uniform heat-transfer profile between hot and cold circuits in a heat exchanger that reduces frosting (i.e., condensation and freezing of water vapor) that occurs on heat transfer surfaces in the vicinity where a hot fluid enters the heat exchanger when the hot fluid is air that contains water vapor. A non-uniform heat-transfer profile can be established by creating a non-uniform fluid entry profile for the cold fluid (i.e., coolant, refrigerant) that enters cold passages (e.g., heat exchanger tubes in a microchannel heat exchanger, cold layers in a plate-fin heat exchanger). A non-uniform heat-transfer profile can also be established by modifying the flow profile of the cold fluid in various regions to create a non-uniform overall heat transfer coefficient. This can improve the overall performance of the heat exchanger by reducing the rate of frosting and/or distributing the frosting more uniformly throughout the heat exchanger core. A heat exchanger layer is an exemplary structure of a circuit for fluid flow in the heat exchanger (e.g., hot circuit, cold circuit).

As will be shown and described in the several embodiments presented in the present disclosure, this concept applies to all heat exchanger core designs, including microchannel and plate-fin heat exchangers, and to all cold fluids including single-phase and two-phase (i.e., boiling) refrigerant systems. For the purpose of disclosing the various embodiments presented herein, coolant, refrigerant, and cold fluid can be used interchangeably to refer to the cold fluid. The hot circuit is designed to use air as the hot fluid, however any gaseous fluid that can contain moisture can also be used, with non-limiting examples including nitrogen, carbon dioxide, and exhaust gas (i.e., combustion products). The hot fluid can be referred to as a first fluid, and the cold fluid can be referred to as a second fluid.

Several embodiments disclosed in the present application each achieve the purpose of improving frosting performance by creating a non-uniform heat transfer rate along the length of the cold layer (i.e., cold circuit) that is in thermal communication with the associated hot layer (i.e., hot circuit).

Figure 1:
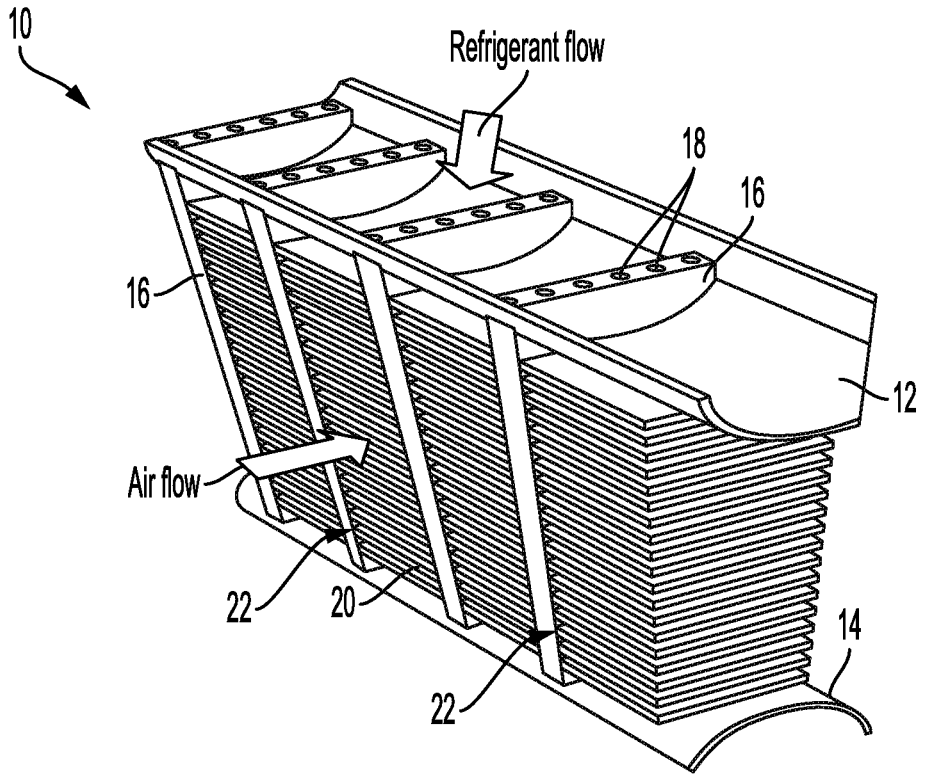
FIG. 1 PRIOR ART
FIG. 1 is a perspective cut-away view of a heat exchanger core of the prior art.

FIG. 1 is a perspective cut-away view of a heat exchanger core of the prior art. Shown in FIG. 1 are heat exchanger core 10, refrigerant supply manifold 12, refrigerant return manifold 14, coolant tube 16, refrigerant channels 18, fins 20, and front 22. The flow of air and refrigerant are also shown in FIG. 1. A refrigerant (i.e., cold fluid, coolant) is supplied to heat exchanger core 10 via refrigerant supply manifold 12, flowing in parallel through a number of coolant tubes 16, and then discharging via refrigerant return manifold 14. Each coolant tube 16 includes a number of refrigerant channels 18. Air flow passes over a number of fins 20, entering heat exchanger core 10 at front 22 and flowing to the back (not labeled in FIG. 1). In a typical embodiment, coolant tubes 16 and fins 20 are made of metal (e.g., aluminum alloy), which removes heat from the air (i.e., hot fluid) by conducting heat through fins 20 into coolant tubes 16, where heat is transferred into the refrigerant flowing through refrigerant channels 18 by thermal convection. Refrigerant channels 18 can be referred to as micro channels, and heat exchanger core 10 can be referred to as a micro channel heat exchanger core.

Figure 2:
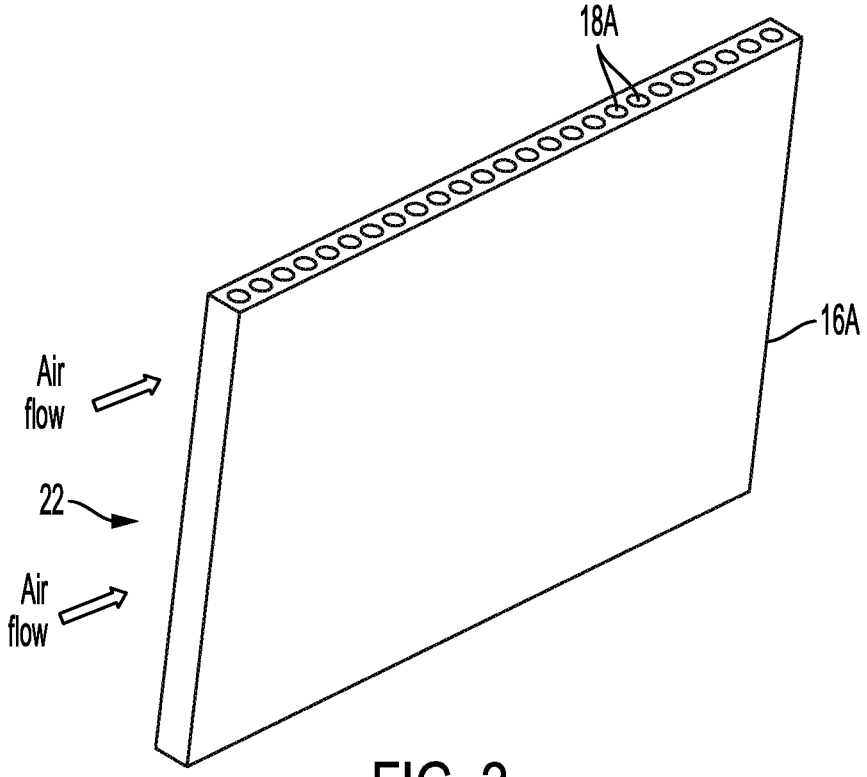
FIG. 2 PRIOR ART
FIG. 2 is a perspective view of a second embodiment of a coolant tube of the prior art.

FIG. 2 is a perspective view of a second embodiment of a coolant tube of the prior art. Shown in FIG. 2 are coolant tube 16A, refrigerant channels 18A, and front 22. Air flow is also shown in FIG. 2. The descriptions of coolant tube 16A and refrigerant channels 18A are substantially similar to those provided above in regard to FIG. 1, although a greater number of refrigerant channels 18A are distributed throughout coolant tube 16A from front 22 to back (not labeled in FIG. 2). In a typical embodiment, an object of coolant tube 16A is to maximize the rate of heat transfer across coolant tube 16A, thereby maximizing the rate of heat transfer from the air to the refrigerant in heat exchanger core 10. Accordingly, refrigerant channels 18A are closely-spaced as shown in FIG. 2 to help maximize the mass flow rate $\dot{m}$ of coolant through each coolant tube 16A. Maximizing the size and/or number of refrigerant channels 18A in coolant tube 16A increases the overall interior surface area A for heat exchange within coolant tube 16A. A general equation for the rate of heat transfer is shown in equation 1, where $\dot{Q}$ is the rate of heat transfer, U is the overall heat transfer coefficient, A is the surface area for heat transfer, R is the overall thermal resistance, and ΔT is the temperature difference:

$$\dot{Q} = UA\Delta T = \frac{\Delta T}{R} \qquad \text{Equation 1}$$

As used in equation 1, heat transfer rate $\dot{Q}$ and thermal resistance R can be applied at a component level. In a similar manner, equation 1 can be applied to describe heat transfer rate per unit area (i.e., heat flux $\dot{Q}''$). Accordingly, as used in the present disclosure, the term thermal resistance will refer to the thermal resistance at a point (e.g., at a point or region within heat exchanger core 10).

Figure 3:
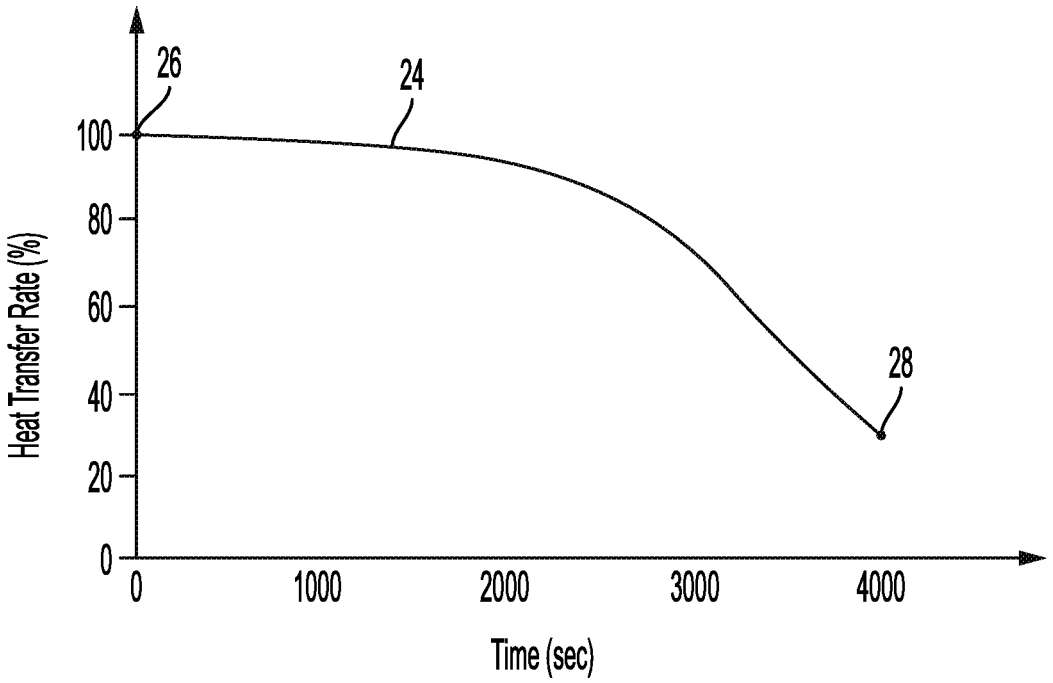
FIG. 3 PRIOR ART
FIG. 3 is a graph of heat transfer rate over time for a heat exchanger with the coolant tube shown in FIG. 2.

FIG. 3 is a graph of heat transfer rate over time for a heat exchanger with coolant tube 16A shown in FIG. 2. Shown in FIG. 3 are heat transfer rate trend 24, starting point 26, and ending point 28. The vertical axis represents heat transfer rate being normalized to show rate as a percentage of full capacity, and the horizontal axis represents time (in seconds). Beginning with starting point 26 at time zero, warm air is introduced to heat exchanger core 10. The cold circuit of heat exchanger core 10 was in operation prior to starting point 26, thereby establishing a flow of refrigerant through coolant tubes 16. Accordingly, maximum heat transfer (i.e., 100%) begins at starting point 26. It is to be appreciated that transient characteristics occurring at or near starting point 26 have been removed from heat transfer rate trend 24. In the illustrated embodiment, air flow entering heat exchanger core 10 contains moisture, and the temperature of the refrigerant entering heat exchanger core 10 is below the freezing point of water (i.e., about 0° C.). Accordingly, frosting occurs by which moisture from the air entering heat exchanger core 10 condenses and freezes on fins 20, thereby forming ice. Frosting also occurs on the outer surfaces of coolant tubes 16, both on the leading edge at front 22 and on the interior surfaces (not labeled) where fins 20 attach to coolant tubes 16. Generally, greater frosting occurs in the region of heat exchanger core 10 near front 22. This can be understood by realizing that air enters front 22 of heat exchanger core 10 at an inlet temperature, and reduces in temperature while passing from front 22 to the back as heat is transferred through heat exchanger core 10. Because refrigerant channels 18, 18A are uniform in size and spacing across coolant tubes 16, 16A, the greatest temperature difference ΔT occurs near front 22. The uniform size and spacing of refrigerant channels 18, 18A from front 22 to the rear generally result in a uniform heat transfer rate along the length (i.e., from front 22 to the rear) of coolant tube 16. Accordingly, as seen from equation 1, the greatest rate of heat transfer $\dot{Q}$ per unit area A (i.e., heat flux $\dot{Q}''$) occurs near front 22, thereby resulting in greater frosting occurring near front 22 as compared to other regions of the heat exchanger core. As ice formation grows over time, the rate of heat transfer $\dot{Q}$ in heat exchanger reduces, which can be caused by several factors. Because heat must flow through the frost (i.e., ice) which adds thermal resistance (i.e., reducing the overall heat transfer coefficient U in equation 1), the rate of heat transfer $\dot{Q}$ reduces because of the accumulation of ice. Additionally, the ice accumulation reduces the cross-sectional area for air flow through heat exchanger core 10, thereby restricting the flow of air, resulting a reduced rate of heat transfer Q. Eventually, the ice accumulation grows to the point of requiring remedial action (e.g., defrosting the heat exchanger core). In the illustrated embodiment, heat transfer rate $\dot{Q}$ has reduced to about 30% at about 4000 seconds (i.e., about 67 minutes) at ending point 28, at which point a defrost cycle must occur to remove the ice accumulation. In an exemplary defrost cycle, warm refrigerant is directed through the cold circuit (i.e., through refrigerant channels 18, 18A), thereby melting some or all of the accumulated ice. Following the defrost cycle, normal operation of heat exchanger core 10 can resume. Accordingly, a periodic defrost cycle must occur during the operation of heat exchanger core 10. Because the defrost cycle interrupts the normal functioning of heat exchanger core, it can be desirable to reduce the rate of frosting near front 22, thereby extending the time period between defrost cycles.

Figure 4:
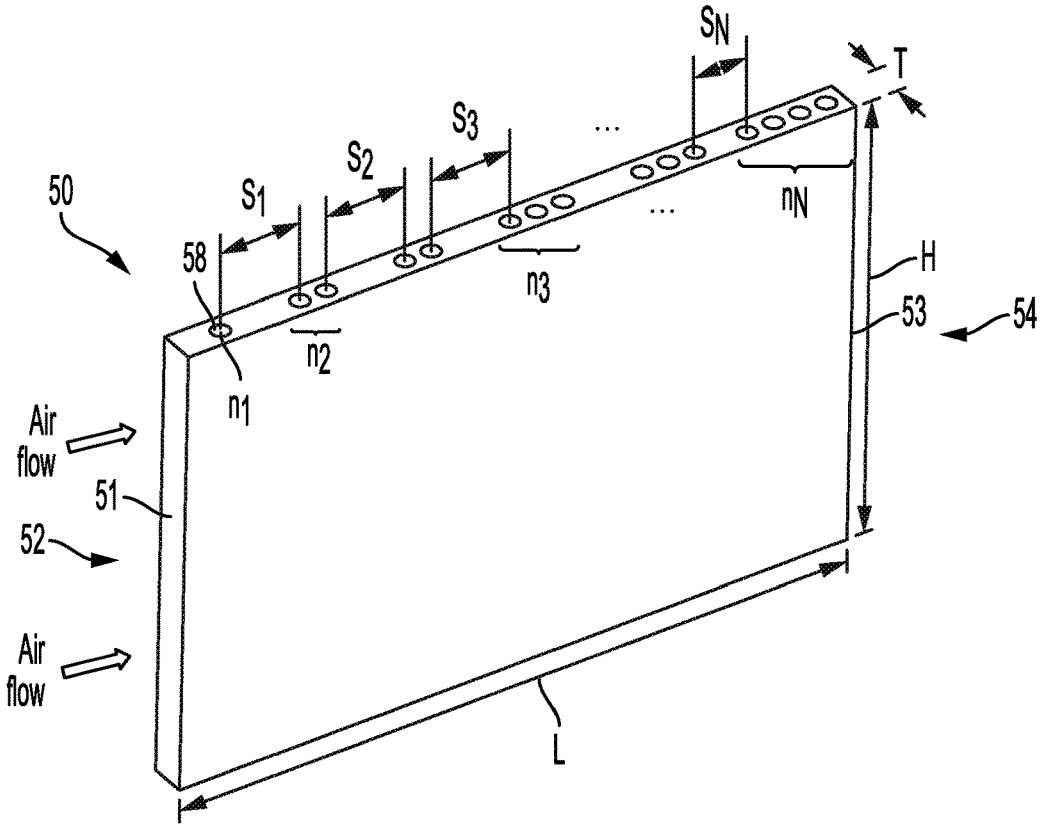
FIG. 4 is a perspective view of a nonlinear coolant tube.

FIG. 4 is a perspective view of a nonlinear coolant tube. Shown in FIG. 4 are nonlinear coolant tube 50, front 51, inlet 52, rear 53, outlet 54, and coolant passages 58. Also shown in FIG. 4 are air flow arrows depicting the hot flow from inlet 52 (i.e., at front 51) to outlet 54 (i.e., at rear 53). Also labeled in FIG. 4 are spacing S, group number n, height H, length L, and thickness T. Nonlinear coolant tube 50 is adapted for use in a heat exchanger core, for example, a heat exchanger core that is outwardly similar to heat exchanger core 10 shown in FIG. 1. In a typical embodiment, a number of nonlinear coolant tubes 50 are arranged in a heat exchanger core, each configured to receive a cold fluid through coolant passages 58. Coolant passages 58 can be referred to as coolant channels, micro-channels, or micro-passages. The associated coolant supply and return headers are not shown in FIG. 4. The coolant (i.e., cold fluid) can be either a single-phase coolant (e.g., glycol), or a two-phase refrigerant (e.g., a halocarbon, FREON™). A two-phase refrigerant can be referred to as a boiling coolant that absorbs heat from a hot fluid through the latent heat of vaporization in transforming the refrigerant from a liquid to a gas. In a typical embodiment, an arrangement of fins (not shown in FIG. 4) is connected between each of the nonlinear coolant tubes 50 and is configured for air to flow over the fins. The heat exchanger core is configured so that air flow enters inlet 52 near front 51 and flows through the fins from inlet 52 to outlet 54 before exiting the heat exchanger core. Front 51 can be referred to as a first edge, and rear 53 can be referred to as a second edge.

Coolant passages 58 are arranged in a planar array within nonlinear coolant tube 50, as depicted in FIG. 4. Coolant passages 58 are arranged in groups from front 51 (i.e., first edge) to rear 53 (i.e., second edge), with each group of coolant passages having a group number n of coolant passages 58. In the illustrated embodiment, the first group (i.e., beginning at front 51) has a single coolant channel 58 (i.e., group number $n_1$), the second group (i.e., moving in the direction from front 51 to rear 53) has two coolant passages 58 (i.e., group number $n_2$), the third group has three coolant passages 58 (i.e., group number $n_3$), and so on. In the illustrated embodiment, the group number n becomes larger moving in the direction from front 51 to rear 53 (i.e., from the first edge to the second edge). Spacing S exists between each of the groups, being measured from the centerline of the edge-most adjacent coolant passages 58 in each group as shown in FIG. 4. Spacing S can be referred to as intergroup separation, or as the coolant passage spacing distance. In the illustrated embodiment, spacing $S_1$ separates the second group from the first group, spacing $S_2$ separates the third group from the second group, spacing $S_3$ separates the fourth group from the third group, and so on. In the illustrated embodiment, spacing S becomes smaller moving in the direction from front 51 to rear 53. It is to be appreciated that the range of group numbers n and/or the range of spacing S can vary in different embodiments, and can also depend on the physical dimensions of nonlinear coolant tube 50 (i.e., height H, length L, thickness T). By manipulating the intergroup separation (i.e., spacing S) and/or the group number n along length L of nonlinear coolant tube 50 from front 51 to rear 53, a non-uniform heat transfer profile (i.e., thermal resistance) occurs along length L of nonlinear coolant tube 50. In other words, the heat flux $\dot{Q}''$ increases along nonlinear coolant tube 50 moving from front 51 to rear 53 (i.e., from the first edge to the second edge, in the direction of air flow through the heat exchanger core). This can improve the overall performance of a heat exchanger using nonlinear coolant tube 50 by reducing the rate of frosting near front 51 and/or distributing the frosting more uniformly throughout the heat exchanger core. In an exemplary embodiment, spacing S and/or group number n along length L of nonlinear coolant tube 50 from front 51 to rear 53 can be configured to result in a uniform rate of frosting along length L of nonlinear coolant tube 50. Several factors can be considered in determining the configuration of spacing S and group number n along length L of nonlinear coolant tube 50, with non-limiting examples including height H, length L, thickness T, expected temperatures and flow rates of the hot fluid (i.e., air) and cold fluid (i.e., coolant) entering the heat exchanger, the expected moisture content of the hot fluid entering the heat exchanger, and the material from which nonlinear coolant tube 50 is made.

In an exemplary embodiment, such as in a heat exchanger used for an air cooler on a commercial aircraft, height H and length L can each range from about 10-40 cm, and thickness T can range from about 1-20 mm, however these dimensions can vary significantly depending on the application. In some embodiments, height H and/or length L can be less than 10 cm or greater than 40 cm. In these or other embodiments, thickness T can be less than 1 mm or more than 20 mm. In yet other embodiments, for example, in an embodiment used in a heating, ventilation, and air-conditioning (HVAC) system in a commercial building, height H and/or length L can be greater than 200 cm. The present disclosure is directed to all sizes of nonlinear coolant tube 50.

In an exemplary embodiment, nonlinear coolant tube 50 is made of an aluminum alloy and can be manufactured by a metal extrusion process. In some embodiments, nonlinear coolant tube 50 can be made of aluminum, copper, nickel, or any alloy of one or more of these metals. In other embodiments, nonlinear coolant tube 50 can be made of any metal and/or non-metal. Exemplary non-metals include polymers (e.g., polypropylene, polyethylene, polyphenylene sulfide (PPS), and polytetrafluoroethylene (PTFE)). In yet other embodiments, nonlinear coolant tube 50 can be made of polymer composites, for example, any of the aforementioned polymers filled with graphite, metallic particles, carbon fibers, and/or carbon nanotubes. In some embodiments, the material used to construct nonlinear coolant tube 50 can be selected to be compatible with a manufacturing process. Exemplary manufacturing processes include extrusion, machining, casting, additive, additive-subtractive, and hybrid additive manufacturing.

Figure 5:
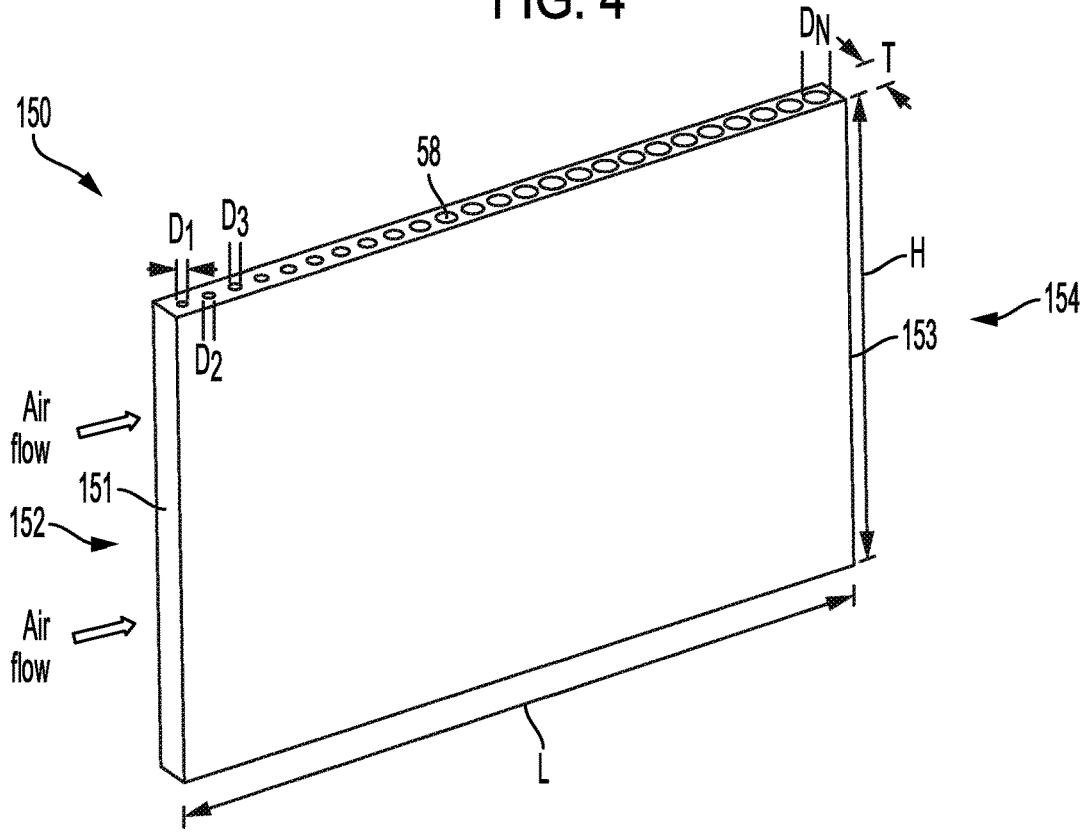
FIG. 5 is a perspective view of second embodiment of a nonlinear coolant tube.

FIG. 5 is a perspective view of second embodiment of a nonlinear coolant tube. Shown in FIG. 5 are nonlinear coolant tube 10, front 151, inlet 152, rear 153, outlet 154, and coolant passages 158. Also shown in FIG. 5 are air flow arrows depicting the flow of the hot flow from inlet 152 (i.e., at front 151) to outlet 154 (i.e., at rear 153). Also labeled in FIG. 5 are diameter D, height H, length L, and thickness T. Nonlinear coolant tube 150 is adapted for use in a heat exchanger core, being substantially similar to the description provided above in regard to FIG. 4. Each coolant passage 158 has a diameter D, with coolant passages 158 being arranged in order of increasing diameter D from front 151 to rear 153, and with the hot fluid (i.e., air) flowing. Front 151 can be referred to as a first edge, and rear 153 can be referred to as a second edge. In the illustrated embodiment, the first coolant passage 158 (i.e., beginning at front 151) has diameter $D_1$, the second coolant passage 158 (i.e., moving in the direction from front 151 to rear 153) has diameter $D_2$ which is greater than $D_1$, the third coolant passage 158 has diameter $D_3$ which is greater than $D_2$, and so on. The last coolant passage 158 (i.e., nearest rear 153) has diameter $D_N$ which is larger than all previous diameters D. It is to be appreciated that diameter $D_N$ can be dictated, at least in part, by thickness T. In the illustrated embodiment, diameter D of coolant passages 158 steadily increases in the direction of length L from front 151 to rear 153. For any particular coolant passage 158, diameter D affects the heat flux $\dot{Q}''$ in the vicinity of the particular coolant passage 158 by affecting the mass flow rate $\dot{m}$ of coolant through that particular coolant passage 158. Accordingly, by manipulating the arrangement of diameters D of each particular coolant passage 158 along length L of nonlinear coolant tube 150 from front 151 to rear 153, a non-uniform heat transfer rate (i.e., thermal resistance) occurs along length L of nonlinear coolant tube 150. In other words, the heat flux $\dot{Q}''$ increases along nonlinear coolant tube 150 moving from front 151 to rear 153 (i.e., in the direction of air flow through the heat exchanger core, from the first edge to the second edge). Accordingly, frosting near front 151 is reduced. In an exemplary embodiment, the arrangement of diameters D across nonlinear coolant tube 150 from front 151 to rear 153 can be configured to result in a uniform rate of frosting along length L of nonlinear coolant tube 150. In each particular coolant passage 158, diameter D results in a coolant passage flow area A, as given by the equation $A=0.25\pi D^2$. Accordingly, coolant passage flow area A steadily increases in the direction of length L from front 151 to rear 153. In the illustrated embodiment, coolant passages 158 have a round cross-sectional shape (i.e., as defined by diameter D). In other embodiments, coolant passages 158 can have any cross-sectional shape, while preserving the defined relationship in coolant passage flow areas A.

Figure 6A:
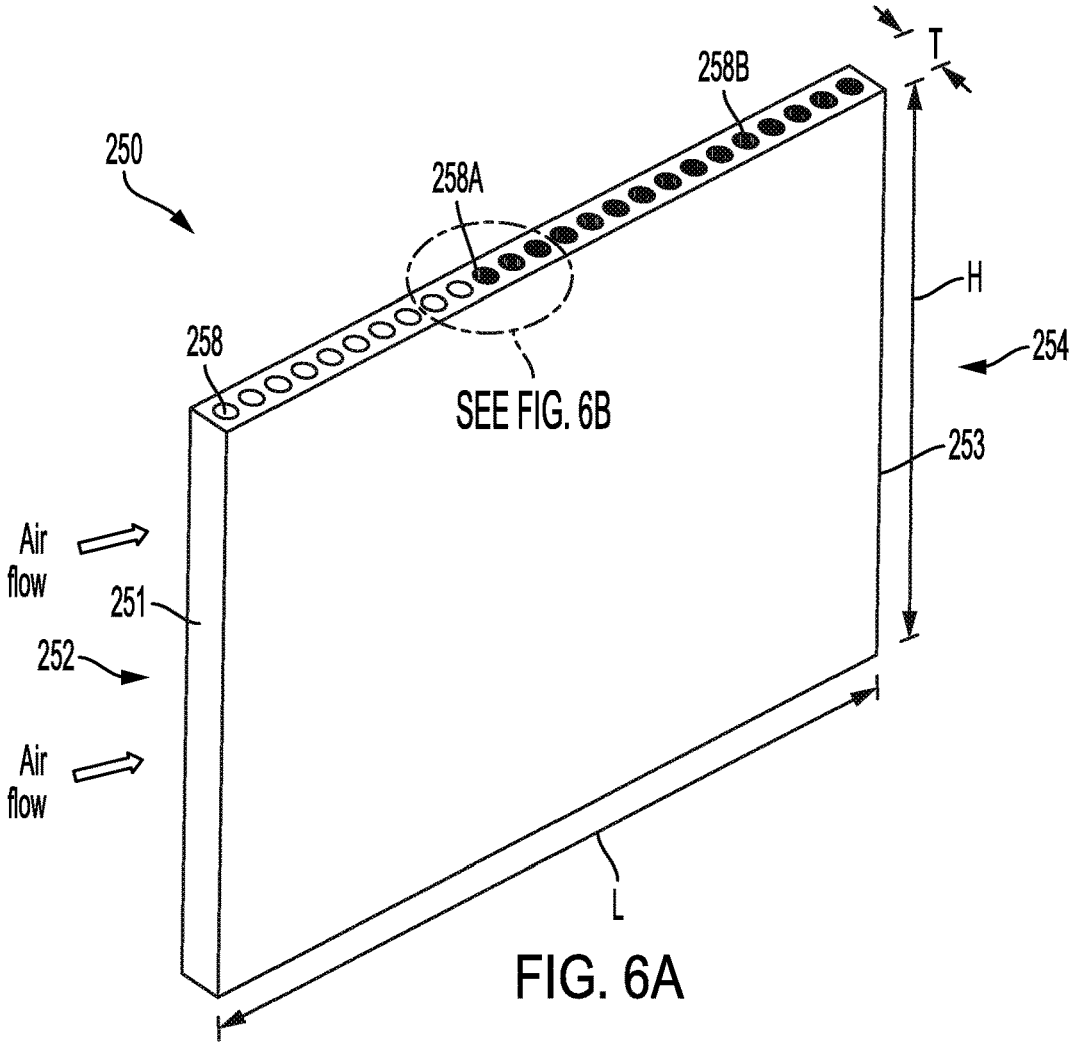
FIG. 6A is a perspective view of third embodiment of a nonlinear coolant tube.
Figure 6B:
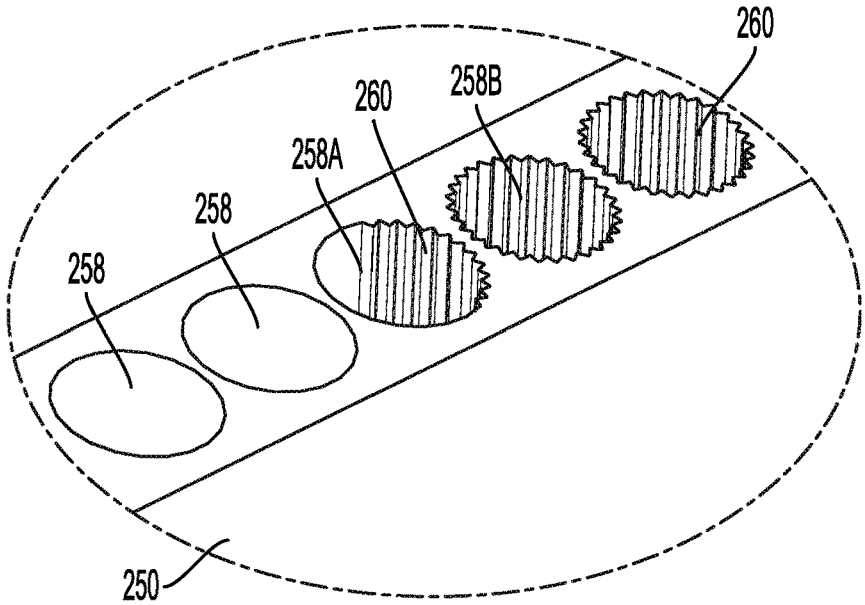
FIG. 6B is an enlarged perspective view showing detail of the nonlinear coolant tube shown in FIG. 6A.
Figure 6C:
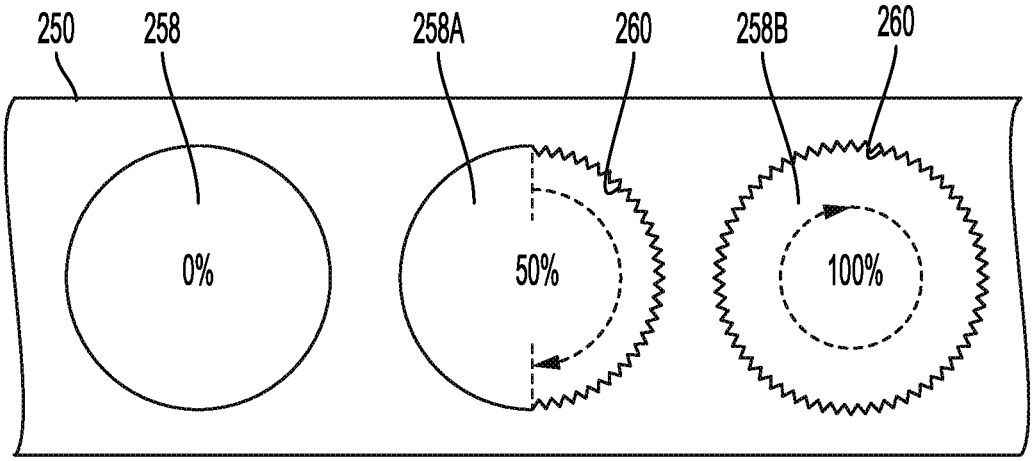
FIG. 6C is an enlarged top view showing detail of the nonlinear coolant tube shown in FIG. 6B.

FIG. 6A is a perspective view of third embodiment of a nonlinear coolant tube. FIG. 6B is an enlarged perspective view showing detail of the nonlinear coolant tube shown in FIG. 6A. FIG. 6C is an enlarged top view showing detail of the nonlinear coolant tube shown in FIG. 6B. Shown in FIGS. 6A-6C are nonlinear coolant tube 250, front 251, inlet 252, rear 253, outlet 254, coolant passages 258, 258A, 258B, and grooves 260. Nonlinear coolant tube 250 is adapted for use in a heat exchanger core, being substantially similar to the description provided above in regard to FIG. 4. Front 251 can be referred to as a first edge, and rear 253 can be referred to as a second edge. In the illustrated embodiment, the spacing and diameter of coolant passages 258, 258A, 258B (not labeled in FIGS. 6A-6C) are all about the same, but different coolant passages 258, 258A, 258B have different interior surfaces. Coolant passages 258 nearest front 251 have a generally smooth interior surface. Coolant passages 258A in a central region between front 251 and rear 253 include grooves 260 along a portion of the interior while having have a generally smooth surface along another portion of the interior. Coolant passages 258B nearest rear 253 include grooves 260 along the entire interior. Accordingly, coolant passages 258, 258A, 258B can be described as having multiple zones of surface roughness, thereby resulting in multiple zones of overall heat transfer coefficient U.

In the illustrated embodiment, grooves 260 are surface irregularities that run the height H of each coolant passage 258A, 258B, which increase the overall heat transfer coefficient U (i.e., reduces thermal resistance) by creating greater flow turbulence (i.e., disrupting the boundary layer caused by a relatively smooth surface). Under some conditions, the boundary layer can include components of laminar flow. The present disclosure will generally describe fluid flow in terms of the boundary layer (i.e., the layer of fluid near a surface where heat transfer can occur), with reference to disturbing the boundary layer by means of causing a boundary layer disruption (i.e., greater turbulence). Grooves 260 can also be referred to as turbulators, ribs, riblets, or as surface texturing. The distribution of grooves 260 (i.e., surface texturing) on the interior surface of a particular coolant passage 258A, 258B can be referred to as a texturing ratio. Therefore, coolant passage 258 having a smooth interior has a surface texturing ratio of 0%, and coolant passage 258B having grooves 260 entirely covering the interior surface has a surface texturing ratio of 100%. In the illustrated embodiment, nonlinear coolant tube 250 includes three zones of surface texturing ratio, representing about 0%, 50%, and 100% moving from the first zone (i.e., near front 251) to the third zone (i.e., near rear 253). In some embodiments, only two zones of surface texturing ratio can be used. In other embodiments, more than three zones of surface texturing ratio can be used. In yet other embodiments, surface texturing ratio can steadily increase along length L of nonlinear coolant tube 250 from front 251 to rear 253 (i.e., from the first edge to the second edge, in the direction of air flow through the heat exchanger core).

By manipulating the distribution of surface texturing ratio along length L of nonlinear coolant tube 250 from front 251 to rear 253, a non-uniform heat transfer rate (i.e., thermal resistance) occurs along length L of nonlinear coolant tube 250. In other words, the heat flux $\dot{Q}''$ increases along nonlinear coolant tube 250 moving from front 251 to rear 253 (i.e., from the first edge to the second edge, in the direction of air flow through the heat exchanger core). Accordingly, frosting near front 251 is reduced. In an exemplary embodiment, the surface texturing ratio distribution along length L of nonlinear coolant tube 250 from front 251 to rear 253 can be configured to result in a uniform rate of frosting along length L of nonlinear coolant tube 250.

Figure 6D:
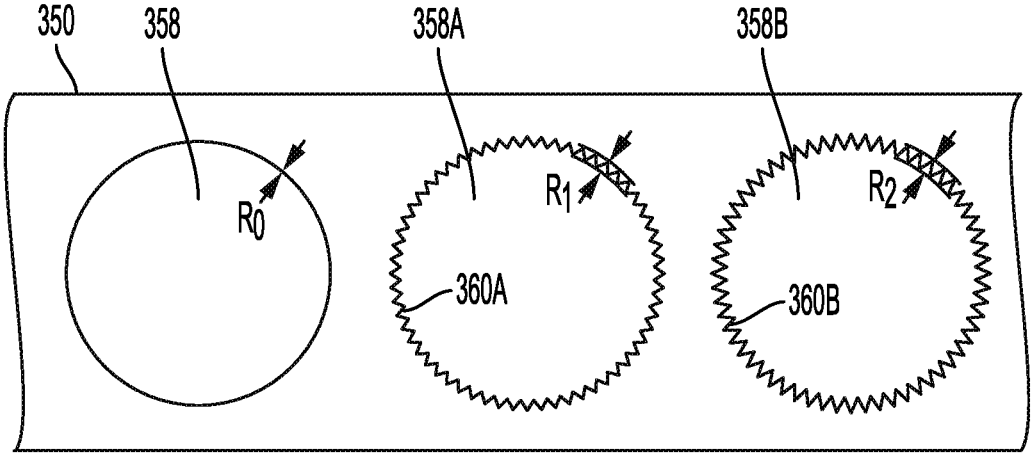
FIG. 6D is a top view showing detail of a fourth embodiment of a nonlinear coolant tube.

FIG. 6D is a top view showing detail of a fourth embodiment of a nonlinear coolant tube. Shown in FIG. 6D are nonlinear coolant tube 350, coolant passages 358, 358A, 358B, and grooves 360A, 360B. Also labeled in FIG. 6D is ridge heights $R_0$, $R_1$, and $R_2$. It is to be appreciated that FIG. 6D shows an enlarged portion of nonlinear coolant tube 350 in a manner similar to that of FIG. 6C, described above. The descriptions of nonlinear coolant tube 350, coolant passages 358, 358A, 358B, and grooves 360A, 360B are substantially similar to those provided above in regard to FIGS. 6A-6C, while noting that grooves 360A and 360B have different heights. Grooves 360A, 360B can be described as a repeating surface pattern of toughs having alternating peaks and valleys (not labeled in FIG. 6D). Accordingly, ridge heights $R_0$, $R_1$, and $R_2$ measure the height of each groove 360A, 360B from the valley to the peak, as shown in FIG. 6D. In the illustrated embodiment, coolant passage 358 does not include grooves. Accordingly, ridge height $R_0$ of coolant passage 358 is approximately zero.

In the exemplary embodiments illustrated in FIGS. 6A-6D, nonlinear coolant tube 250, 350 can be made of a metal alloy using an extrusion process, thereby resulting in the illustrated pattern of grooves 260, 360A, 360B. In other embodiments using other manufacturing processes (e.g., machining, casting, additive, additive-subtractive, hybrid additive manufacturing), other patterns of surface texturing are possible. In some of these other embodiments, the interior surfaces of coolant passages 258, 358 can be characterized as a surface roughness. Accordingly, in these other embodiments, the surface roughness of a particular surface region in a coolant passage 258, 358 can be characterized as a surface roughness value.

In the exemplary embodiments shown in FIGS. 4, 5, and 6A-6D, one or two parameters were varied along length L of nonlinear coolant tube 50, 150, 250 to improve frosting performance by creating a non-uniform heat transfer (i.e., thermal resistance) profile. It is to be appreciated that multiple parameters can be combined in different combinations in various embodiments. For example, spacing S and/or group number n of nonlinear coolant tube 50 shown in FIG. 4 can be combined with diameter D distribution of nonlinear coolant tube 150 shown in FIG. 5. In any of these combinations, surface texturing (e.g., grooves 260, 360A, 360B) can also be used as illustrated on nonlinear coolant tube 250, 350 shown in FIGS. 6A-6D. All means of establishing a non-uniform heat transfer rate (i.e., thermal resistance) along length L of nonlinear coolant tube 50, 150, 250, 350 are within the scope of the present disclosure.

Figure 7:
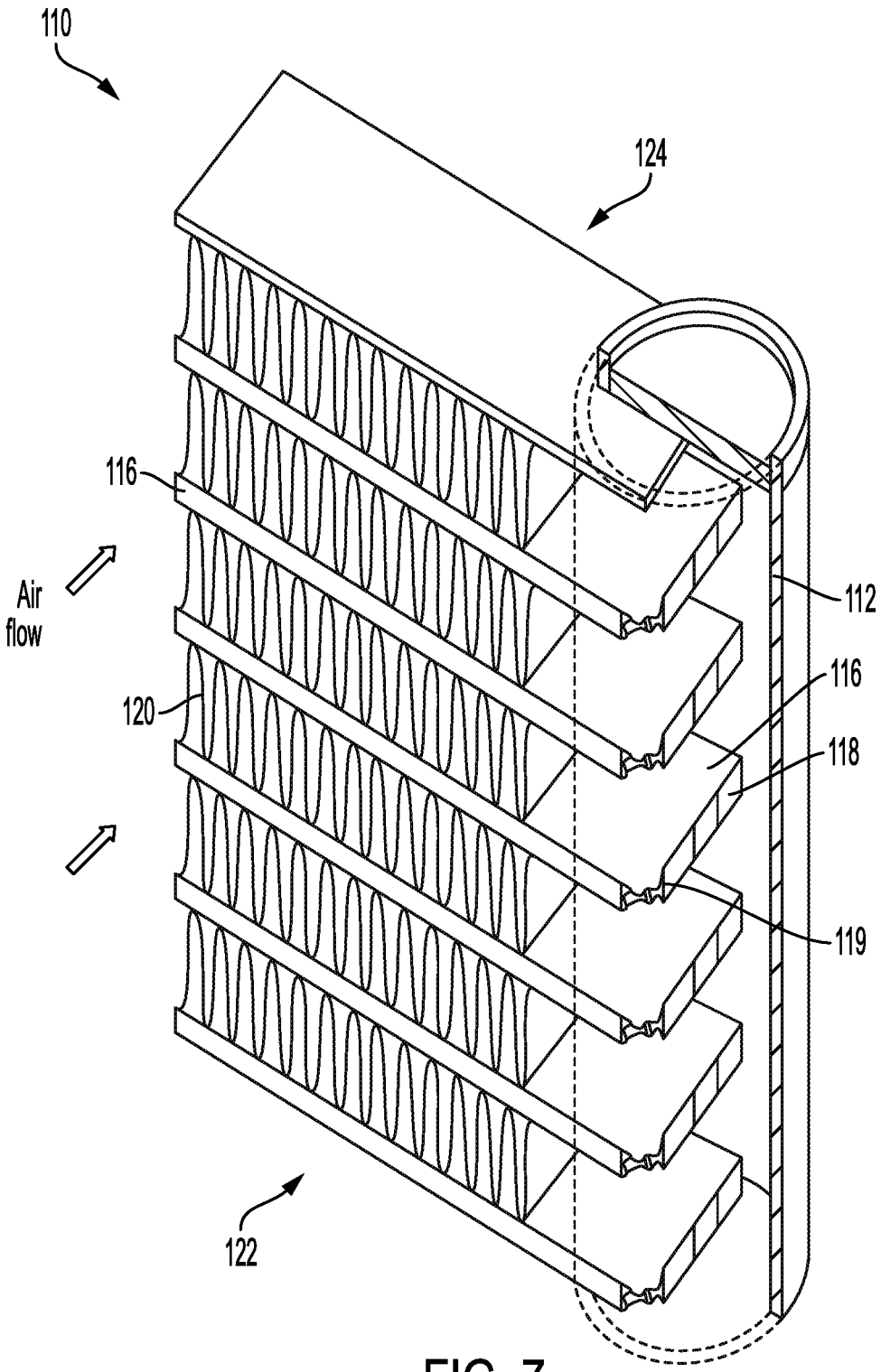
FIG. 7 is a perspective cut-away view of a fifth embodiment of a nonlinear coolant tube.

FIG. 7 is a perspective cut-away view of a fifth embodiment of a nonlinear coolant tube. Shown in FIG. 7 are heat exchanger core 110, refrigerant supply manifold 112, nonlinear coolant tube 116, refrigerant passages 118, crimps 119, fins 120, inlet 122, and outlet 124. Heat exchanger core 110 is adapted to provide cooling of air in a heat exchanger. A refrigerant is supplied via refrigerant supply manifold 112, directing the refrigerant (i.e., coolant) through refrigerant passages 118 in nonlinear coolant tube 116, and out through the refrigerant return manifold (not shown in FIG. 7). Air (i.e., hot fluid) is directed to inlet 122 (i.e., the front) of heat exchanger core 110, flowing over fins 120, and discharges through outlet 124, conducting heat through fins 120 into nonlinear coolant tube 116, thereby cooling the incoming air. Inlet 122 (i.e., the front) can be referred to as a first edge, and the outlet 124 (i.e., the rear) can be referred to as a second edge. Convective heat transfer to the refrigerant flowing through refrigerant passages 118 removes heat from nonlinear coolant tubes, in a manner substantially similar to that described above in regard to FIG. 4. Crimp 119 located on one or more of refrigerant passages 118 near inlet 122 restrict the flow of refrigerant through the associated refrigerant passage(s) 118, thereby reducing the flow of refrigerant, thereby reducing the overall heat transfer coefficient U along nonlinear coolant tube(s) 116 near inlet 122. This reduces the heat flux $\dot{Q}''$ along nonlinear coolant tubes 116 near front, reducing the rate of frosting near inlet 122. In some embodiments, multiple crimps 119 can be applied along nonlinear coolant tube 116, ranging in size from inlet 122 to outlet 124 (i.e., the rear). As used in the present disclosure, a larger crimp 119 results in a greater flow restriction for refrigerant. Accordingly, in some embodiments, a large crimp 119 can be applied near inlet 122, and progressively smaller crimps 119 can be applied in the direction moving from inlet 122 to outlet 124. By manipulating the distribution of crimps 119 along the length (not labeled in FIG. 7) of nonlinear coolant tube 116 from inlet 122 to outlet 124, a non-uniform heat transfer rate (i.e., thermal resistance) occurs along the length of nonlinear coolant tube 116. In other words, the heat flux $\dot{Q}''$ increases along nonlinear coolant tube 116 moving from inlet 122 to outlet 124 (i.e., in the direction of air flow through heat exchanger core 110). Accordingly, frosting near inlet 122 is reduced. In an exemplary embodiment, the distribution of crimps 119 along the length of nonlinear coolant tube 116 from inlet 122 to outlet 124 can be configured to result in a uniform rate of frosting along the length of nonlinear coolant tube 116.

In the illustrated embodiment, crimps 119 are located on nonlinear coolant tubes 116 where the refrigerant enters nonlinear coolant tubes 116 (i.e., within refrigerant supply manifold 112). In some embodiments, one or more crimps 119 can be located on nonlinear coolant tubes 116 where refrigerant exits nonlinear coolant tubes 116 (i.e., within the refrigerant return manifold) in addition to, and/or instead of, being located where the refrigerant enters nonlinear coolant tubes 116.

Figure 8:
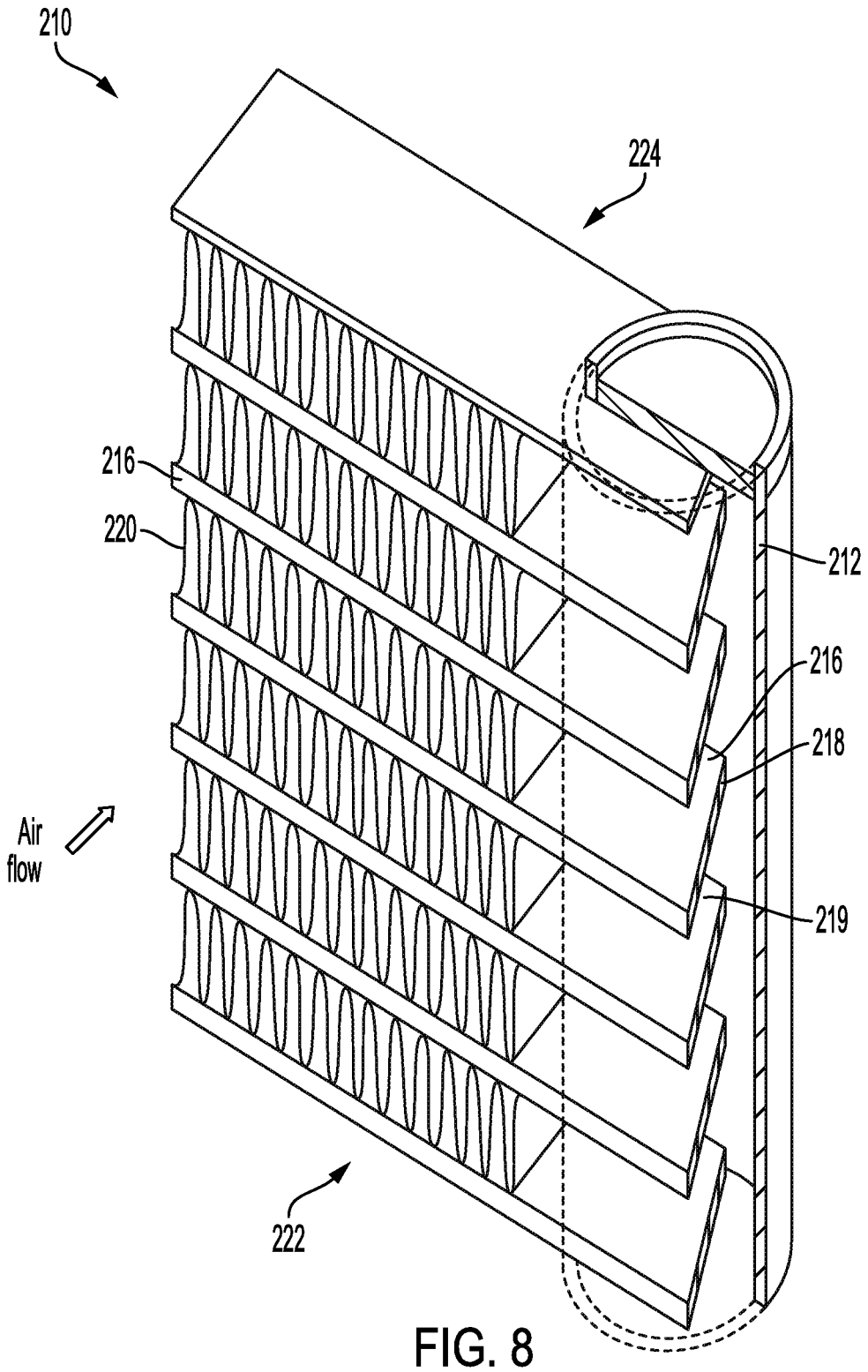
FIG. 8 is a perspective cut-away view of a sixth embodiment of a nonlinear heat exchanger tube.

FIG. 8 is a perspective cut-away view of a sixth embodiment of a nonlinear heat exchanger tube. Shown in FIG. 8 are heat exchanger core 210, refrigerant supply manifold 212, nonlinear coolant tube 216, refrigerant passages 218, protrusions 219, fins 220, inlet 222, and outlet 224. The descriptions of heat exchanger core 210, refrigerant supply manifold 212, nonlinear coolant tube 216, refrigerant passages 218, fins 220, inlet 222, and outlet 224 are substantially as provided above in regard to FIG. 7. Inlet 222 can be referred to as a first edge, and outlet 224 can be referred to as a second edge. A protrusion 219 is on each nonlinear coolant tube 216 near inlet 222, protruding into refrigerant supply manifold 212, thereby restricting the flow of refrigerant into refrigerant passages 218 near inlet 222. In the illustrated embodiment, protrusion 219 is linear, being greatest near inlet 222 and tapering off toward the rear. In other words, the entrance end of nonlinear coolant tube 216, as viewed from the top, would appear triangular in shape. In some embodiments, protrusion 219 can have other profiles (i.e., shapes). By restricting the flow of refrigerant into refrigerant passages 218 near inlet 222, a non-uniform heat transfer rate (i.e., thermal resistance) occurs along the length (not labeled in FIG. 8) of nonlinear coolant tube 216. In other words, the heat flux $\dot{Q}''$ increases along nonlinear coolant tube 216 moving from inlet 222 to outlet 224 (i.e., in the direction of air flow through heat exchanger core 210). Accordingly, frosting near inlet 222 is reduced. In an exemplary embodiment, the profile of protrusion 219 can be configured to result in a uniform rate of frosting along the length of nonlinear coolant tube 216.

In the illustrated embodiment, protrusion 219 is located on nonlinear coolant tubes 216 where the refrigerant enters nonlinear coolant tubes 216 (i.e., within refrigerant supply manifold 212). In some embodiments, protrusions 219 can be located on nonlinear coolant tubes 216 where refrigerant exits nonlinear coolant tubes 216 (i.e., within the refrigerant return manifold) in addition to, and/or instead of, being located where the refrigerant enters nonlinear coolant tubes 216.

Figure 9:
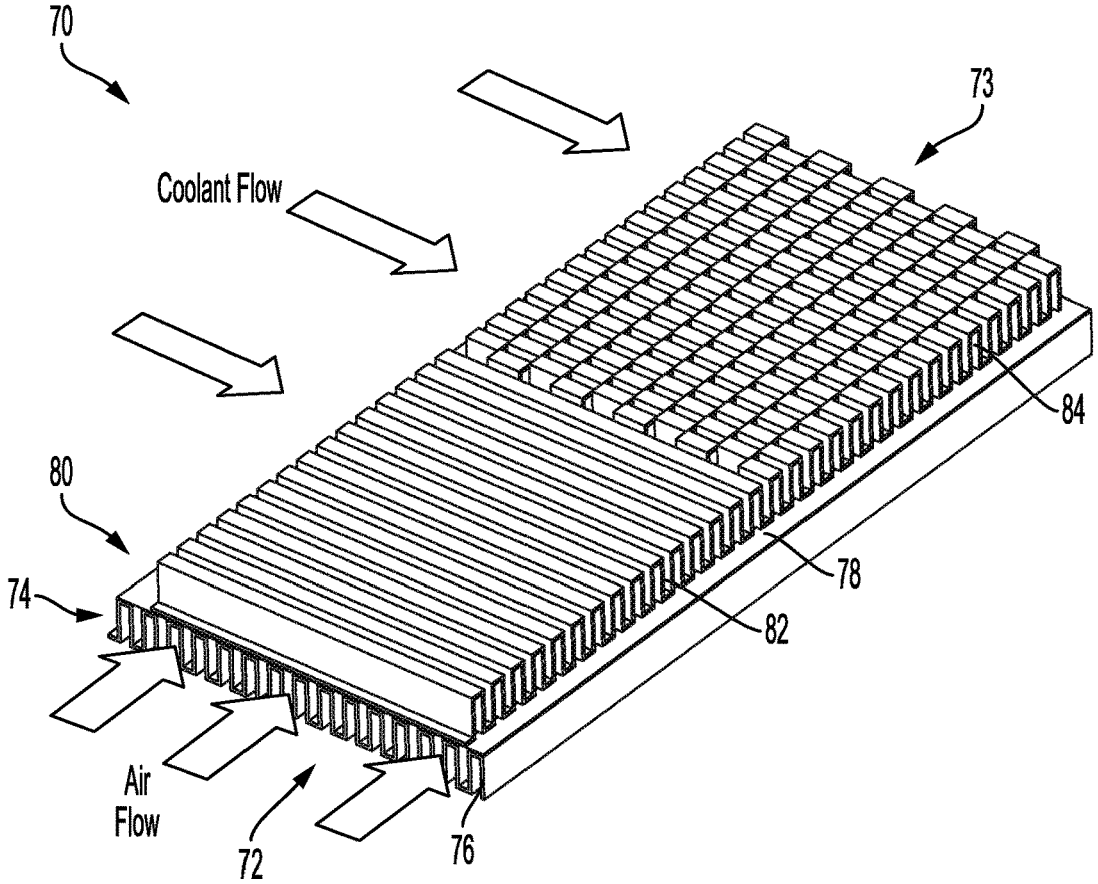
FIG. 9 is a perspective view of a nonlinear heat exchanger refrigerant layer and an associated hot layer.

FIG. 9 is a perspective view of a nonlinear heat exchanger refrigerant layer and an associated hot layer. Shown in FIG. 9 are core section 70, air inlet 72, air outlet 73, hot layer 74, hot fin 76, parting sheet 78, cold layer 80, first cold fin 82, and second cold fin 84. Core section 70 is a portion of a cross-flow plate-fin heat exchanger core, comprised of alternating hot layers 74 and cold layers 80 separated by parting sheets 78. Cold layer 80 can be referred to as a nonlinear coolant tube. Air enters air inlet 72 (i.e., front) of core section 70 and flows through cold layer 80 (i.e., nonlinear coolant tube) to air outlet 73, transferring heat to hot fin 76 by convection, conducting heat across parting sheet 78 into first and second cold fins 82, 84, and transferring heat into the coolant flowing through first and second cold fins 82, 84 by convection. First cold fin 82 is smooth and continuous along the direction of coolant flow, thereby resulting in a relatively undisturbed boundary layer in the coolant against first cold fin 82. Accordingly, the heat flux $\dot{Q}''$ across first cold fin 82 (i.e., near air flow inlet 72) is established by the overall heat transfer coefficient $U_1$ resulting from the profile of first cold fin 82. Second cold fin 84 includes repeating discontinuities (i.e., offset fin elements) that produce flow discontinuities, thereby disrupting the laminar boundary layer in the coolant against second cold fin 84. This can be referred to as creating greater flow turbulence, thereby increasing the overall heat transfer coefficient $U_2$ as compared to first cold fin 82. The increased overall heat transfer coefficient $U_2$ with second cold fin 84 causes a greater heat flux $\dot{Q}''$ across second cold fin 84 as compared to first cold fin 82. By causing greater refrigerant flow turbulence (i.e., greater boundary layer disruption) toward air outlet 73 (i.e., at the rear of the heat exchanger core), a non-uniform heat transfer rate (i.e., thermal resistance) occurs along the length (not labeled in FIG. 9) of hot layer 74. In other words, the heat flux $\dot{Q}''$ increases along hot layer 74 moving from air inlet 72 to air outlet 73) in the direction of air flow through the heat exchanger core. Accordingly, frosting near air inlet 72 is reduced, thereby more evenly distributing frosting throughout hot layer 74. In an exemplary embodiment, the profile of refrigerant flow turbulence can be configured by adding additional cold fin designs to result in a uniform rate of frosting along the length of hot layer 74.

Figure 10:
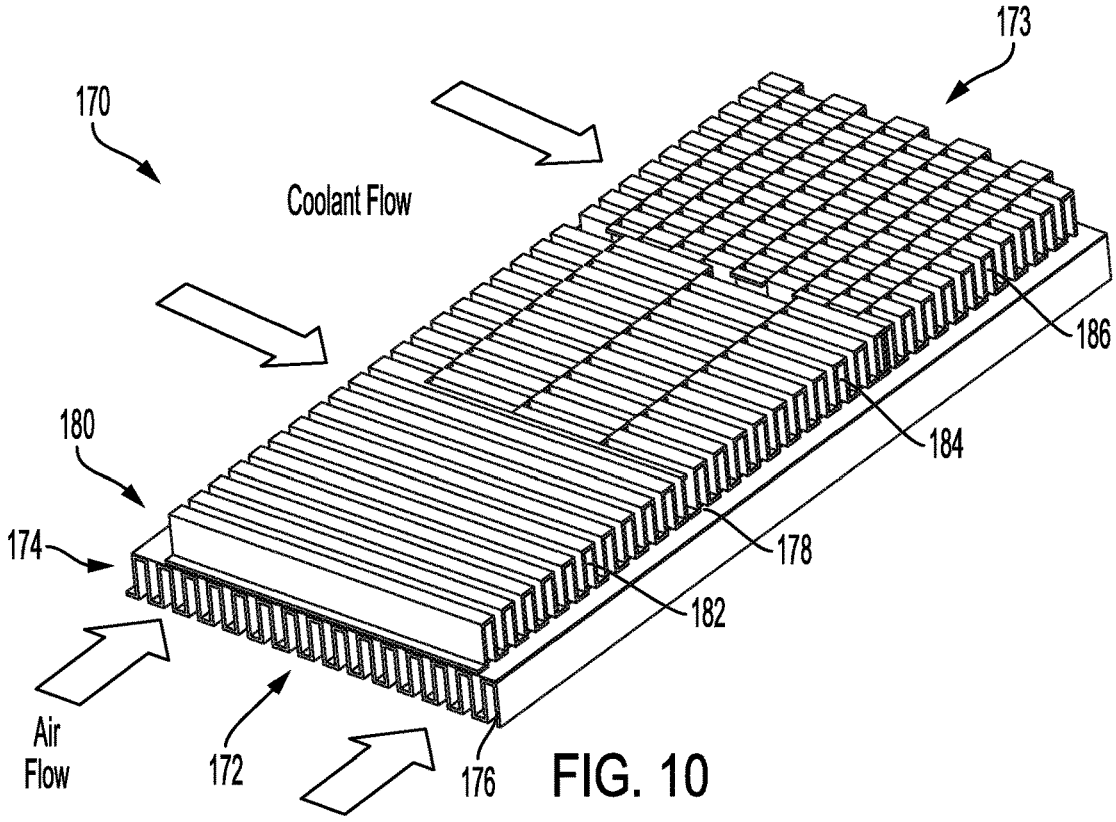
FIG. 10 is a perspective view of a second embodiment of a nonlinear heat exchanger refrigerant layer and an associated hot layer.

FIG. 10 is a perspective view of a second embodiment of a nonlinear heat exchanger refrigerant layer and an associated hot layer. Shown in FIG. 10 are core section 170, air inlet 172, air outlet 173, hot layer 174, hot fin 176, parting sheet 178, cold layer 180, first cold fin 182, second cold fin 184, and third cold fin 186. Cold layer 180 can be referred to as a nonlinear coolant tube. The descriptions of core section 170, air inlet 172, air outlet 173, hot layer 174, hot fin 176, parting sheet 178, and cold layer 180 are substantially as provided above in regard to FIG. 9, with cold layer 180 having three zones of cold layer flow turbulence that are caused by three different cold fin designs. First cold fin 182 is smooth and continuous, resulting in minimal refrigerant flow turbulence and an associated overall heat transfer coefficient $U_1$. Second cold fin 184 has a moderate number of repeating discontinuities (i.e., offset fin elements) that produce flow discontinuities, thereby causing some disruption of the boundary layer in the coolant against second cold fin 184 and an increased overall heat transfer coefficient $U_2$. Third cold fin 186 has the greatest number of repeating discontinuities (i.e., offset fin elements) that produce the greatest flow discontinuities, thereby causing maximum disruption of the boundary layer in the coolant against third cold fin 184 and a resulting maximum overall heat transfer coefficient $U_3$ as compared to first and second cold fins 182, 184.

In the embodiments illustrated in FIGS. 9-10, a non-uniform heat transfer rate Q in the plate-fin heat exchanger core was established by providing a non-uniform profile in offset cold fins. In some embodiments, other flow disruption features can be used on cold fins 80, 180. Non-limiting examples of flow disruption features include grooves, mixing vanes, and direction-changing sections (e.g., a zig-zag flow pattern).

Figure 11:
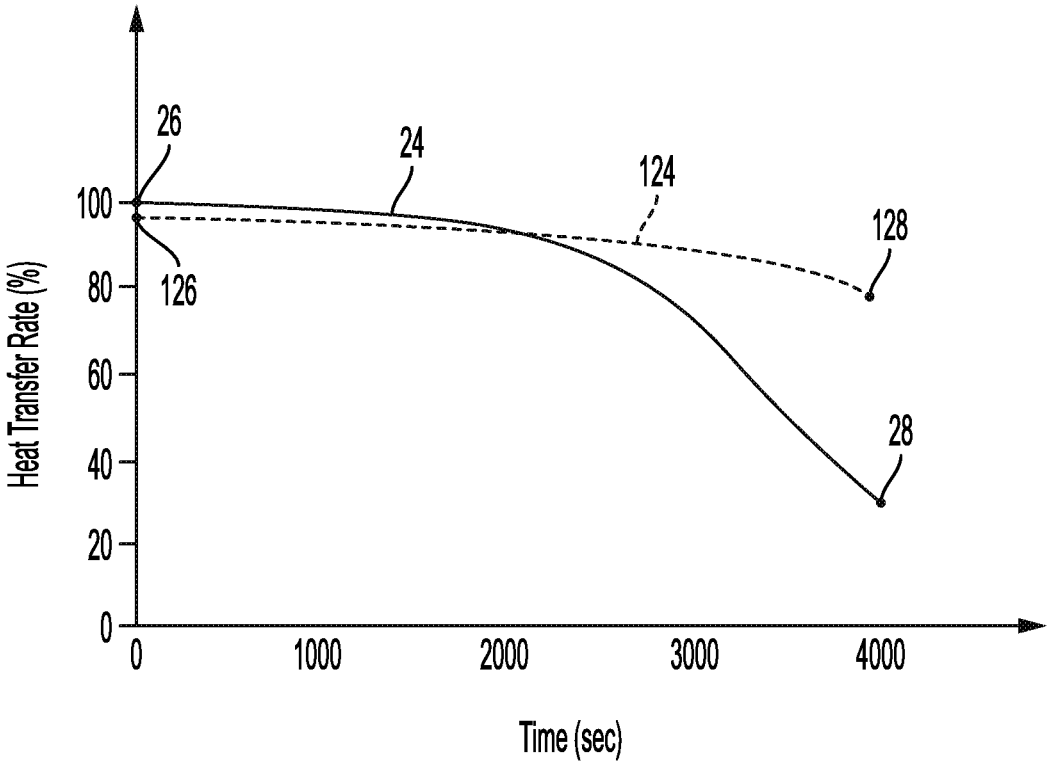
FIG. 11 is a graph of heat transfer rate over time for a heat exchanger with the heat exchanger core shown in FIG. 5.

FIG. 11 is a graph of heat transfer rate over time for a heat exchanger with the heat exchanger core shown in FIG. 5, shown superimposed on the graph shown in FIG. 3. Shown in FIG. 11 are heat transfer rate trend 124, starting point 126, and ending point 128, along with heat transfer rate trend 24, starting point 26, and ending point 28 as shown in FIG. 3. The description of the axes in FIG. 11 are the same as those provided above in regard to FIG. 3. Because nonlinear coolant tube 150 has a reduction in diameter D (i.e., coolant passage flow area A) of coolant passages 158 near front 152 as compared to coolant tube 16 shown in FIG. 2, the overall mass flow rate $\dot{m}$ of coolant through nonlinear coolant tube 150 is reduced compared to that of coolant tube 16, thereby resulting in a reduced heat transfer rate $\dot{Q}$ in nonlinear coolant tube 150 as compared to that of coolant tube 16. Because of this, the initial heat transfer rate $\dot{Q}$ starting point 126 is about 93% on the vertical axis (i.e., being normalized relative to a heat exchanger using coolant tube 16). As noted above in regard to FIG. 3, transient characteristics occurring at or near starting point 126 have been removed from heat transfer rate trend 124. Because of the improved frosting performance of the heat exchanger made using nonlinear coolant tubes 150, the reduction in heat transfer rate $\dot{Q}$ over time (i.e., the negative slope of heat transfer rate trend 124) is reduced, resulting in a more stable heat exchanger performance. After about 4000 seconds (about 67 minutes), heat transfer rate $\dot{Q}$ at ending point 128 for the heat exchanger using nonlinear coolant tube 150 has reduced to about 80%. Recalling from FIG. 3, heat transfer rate $\dot{Q}$ was about 30% at ending point 28, thereby requiring that a defrost cycle be performed. It is to be appreciated that ending point 128 denotes the end of data logging for the experiment depicted in FIG. 11, and not the point at which a defrost cycle is required for the heat exchanger made using nonlinear coolant tubes 150. To the contrary, the operation of a heat exchanger using nonlinear coolant tube 150 could continue for a significant time beyond ending point 128.

In some embodiments, a heat exchanger made using nonlinear coolant tubes 150 can allow a period between defrost cycles that is about 3-5 times longer than that of a heat exchanger using a coolant tube of the prior art. In other embodiments, the period of time can be more than 5 times longer. The resulting longer duration of operation between defrost cycles for a heat exchanger made using nonlinear coolant tubes 150 can result in greater operational efficiency, reduced service interruption, and overall improved thermal performance. In an embodiment where the defrost time period is extended by a factor of 4 (i.e., from 4000 seconds to about 16,000 seconds), the resulting operating time period (i.e., about 4.4 hours) can exceed an operational period. In an exemplary embodiment, a heat exchanger using nonlinear coolant tubes 150 can be used as an air cooler on an aircraft used for domestic flights. In situations where the flight time is less than about 4.4 hours, it may be possible to operate the heat exchanger without service interruption during the flight. Moreover, because of the thermal transient associated with a defrost cycle, the fatigue loading as a result of cyclical thermal stress on nonlinear coolant tubes 150 is reduced, which can improve the service life expectancy of a heat exchanger made from nonlinear coolant tubes 150.

Heat transfer rate trend 124 shown in FIG. 11 depicted the performance of the embodiment of nonlinear coolant tubes 150 shown in FIG. 5. It is to be appreciated that similar improved frosting performance will result from all embodiments of the present disclosure (i.e., including nonlinear coolant tubes 50, 250, 116, 216 shown in FIGS. 4, 6A-6B, and 7-8, and cold layers 80, 180 shown in FIGS. 9-10. Accordingly, with appropriate modification of the vertical scale, heat transfer rate trend 124 shown in FIG. 11 could be used to depict the performance of any of the embodiments presented in the present disclosure.

DISCUSSION OF POSSIBLE EMBODIMENTS

The following are non-exclusive descriptions of possible embodiments of the present invention.

A nonlinear coolant tube adapted for use in a heat exchanger core, the heat exchanger core configured to port a hot fluid therethrough and a cold fluid therethrough while maintaining isolation of the hot fluid from the cold fluid, and including a hot circuit defining a hot circuit inlet, a hot circuit outlet, a first edge, and a second edge, the first edge distal the second edge, the first edge proximate the hot circuit inlet and the second edge proximate the hot circuit outlet, the nonlinear coolant tube being configured to provide a non-uniform heat transfer profile between the hot fluid and the cold fluid from the first edge to the second edge, wherein a thermal resistance of the nonlinear coolant tube near the first edge is greater than the thermal resistance of the nonlinear coolant tube near the second edge.

The nonlinear coolant tube of the preceding paragraph can optionally include, additionally and/or alternatively, any one or more of the following features, configurations and/or additional components:

A further embodiment of the foregoing nonlinear coolant tube, further comprising a plurality of coolant passages arranged in a planar array from the first edge to the second edge within the nonlinear coolant tube, wherein: any two adjacent coolant passages define a coolant passage spacing distance; and the coolant passage spacing distance between two adjacent coolant passages near the first edge is greater than the coolant passage spacing distance between two adjacent coolant passages near the second edge.

A further embodiment of the foregoing nonlinear coolant tube, wherein the coolant passage spacing distance between each two adjacent coolant passages decreases along a direction from the first edge to the second edge.

A further embodiment of the foregoing nonlinear coolant tube, further comprising a plurality of coolant passages arranged in a planar array from the first edge to the second edge within the nonlinear coolant tube, wherein: each coolant passage defines a coolant passage flow area; and the flow areas of the coolant passages nearer to the first edge is less than the flow areas of the coolant flow passages nearer to the second edge.

A further embodiment of the foregoing nonlinear coolant tube, The nonlinear coolant tube of claim 4, wherein the flow areas of the coolant passages increases between each two adjacent coolant passages along a direction from the first edge to the second edge.

A further embodiment of the foregoing nonlinear coolant tube, The nonlinear coolant tube of claim 1, further comprising a plurality of coolant passages arranged in a planar array from the first edge to the second edge within the nonlinear coolant tube, wherein: each coolant passage defines an interior surface profile comprising texturing, non-texturing, or both; the interior surface profile defines a coolant passage surface texturing ratio; and the coolant passage surface texturing ratio near the first edge is less than the coolant passage surface texturing ratio near the second edge.

A further embodiment of the foregoing nonlinear coolant tube, wherein each coolant passage defines an interior surface profile comprising texturing, and the texturing comprises one or more of grooves, turbulators, and/or riblets.

A further embodiment of the foregoing nonlinear coolant tube, further comprising a plurality of coolant passages arranged in a planar array from the first edge to the second edge within the nonlinear coolant tube, wherein: each coolant passage defines an interior surface profile defining a surface roughness height; and the coolant passage surface roughness height near the first edge is less than the coolant flow passage surface roughness height near the second edge.

A further embodiment of the foregoing nonlinear coolant tube, further comprising a plurality of coolant passages arranged in a planar array from the first edge to the second edge within the nonlinear coolant tube, wherein: one or more of the coolant passages near the first edge includes one or more flow restriction features; and the one or more flow restriction features are configured to reduce a flowrate of cold fluid through the respective coolant passage as compared to a flowrate of the cold fluid through a coolant passage near the second edge.

A further embodiment of the foregoing nonlinear coolant tube, wherein each of the one or more flow restriction features comprise a crimp, the crimp configured to restrict flow into and/or out of the associated coolant passage.

A further embodiment of the foregoing nonlinear coolant tube, further comprising a plurality of coolant passages arranged in a planar array from the first edge to the second edge within the nonlinear coolant tube, wherein: the heat exchanger core further comprises a coolant supply header; the nonlinear coolant tube protrudes into the coolant supply header, defining a protrusion profile, thereby fluidly connecting each of the plurality of coolant passages to the coolant supply header; the protrusion profile is configured so that a flowrate of the cold fluid through one or more coolant passages near the first edge is less than a flow rate of the cold fluid through one or more coolant passages near the second edge.

A further embodiment of the foregoing nonlinear coolant tube, wherein: the heat exchanger core is a cross-flow plate-fin heat exchanger core; the nonlinear coolant tube defines a first zone and a second zone; the first zone is located proximate the first edge; the second zone is downstream of the first zone relative to a direction of flow of the hot fluid through the heat exchanger core; the first zone comprises first zone cold fins that are configured to provide a first zone cold fluid flow profile defining a first zone boundary layer; the second zone comprises second zone cold fins that are configured to provide a second zone cold fluid flow profile defining a second zone boundary layer; and the second zone boundary layer is more disrupted than the first zone boundary layer.

A further embodiment of the foregoing nonlinear coolant tube, wherein: the nonlinear coolant tube further comprises a third zone downstream of the second zone relative to a direction of flow of the hot fluid through the heat exchanger core; and the third zone comprises third zone cold fins that are configured to provide a third zone cold fluid flow profile defining a third zone boundary layer; and the third zone boundary layer is more disrupted than the second zone boundary layer.

A further embodiment of the foregoing nonlinear coolant tube, wherein the nonlinear coolant tube comprises a material selected from the group consisting of nickel, aluminum, titanium, copper, iron, cobalt, or alloys thereof.

A further embodiment of the foregoing nonlinear coolant tube, wherein the nonlinear coolant tube material comprises one or more polymers selected from the group consisting of polypropylene, polyethylene, polyphenylene sulfide (PPS), and polytetrafluoroethylene (PTFE).

A further embodiment of the foregoing nonlinear coolant tube, wherein the one or more polymers includes a fill material selected from the group consisting of graphite, metallic particles, carbon fibers, and carbon nanotubes.

A further embodiment of the foregoing nonlinear coolant tube, wherein the cold fluid is a liquid comprising water, glycol, or combinations thereof.

A further embodiment of the foregoing nonlinear coolant tube, wherein: the cold fluid is a refrigerant; and the refrigerant is configured to change phase from a liquid to a gas, thereby transferring heat from the hot fluid through a latent heat of vaporization.

A further embodiment of the foregoing nonlinear coolant tube, wherein: the hot fluid is air; the air can comprise water vapor; the water vapor can solidify to frost in the heat exchanger core; and the nonlinear coolant tube is configured to reduce frost accumulation near the first edge.

A method of reducing frost accumulation in a hot circuit of a heat exchanger core that includes a hot circuit and a cold circuit, the heat exchanger core configured to port a hot fluid therethrough and a cold fluid therethrough while maintaining isolation of the hot fluid from the cold fluid, the hot circuit defining a hot circuit inlet, a hot circuit outlet, a first edge, and a second edge, the first edge distal the second edge, the first edge proximate the hot circuit inlet and the second edge proximate the hot circuit outlet, the method comprising: configuring the cold circuit to include a nonlinear coolant tube that provides a non-uniform heat transfer profile between the hot fluid and the cold fluid from the first edge to the second edge; wherein a thermal resistance of the nonlinear coolant tube near the first edge is greater than the thermal resistance of the nonlinear coolant tube near the second edge.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A nonlinear coolant tube adapted for use in a heat exchanger core, the heat exchanger core configured to port a hot fluid therethrough and a cold fluid therethrough while maintaining isolation of the hot fluid from the cold fluid, and including a hot circuit defining a hot circuit inlet, a hot circuit outlet, a first edge, and a second edge, the first edge distal the second edge, the first edge proximate the hot circuit inlet and the second edge proximate the hot circuit outlet, the nonlinear coolant tube being configured to provide a non-uniform heat transfer profile between the hot fluid and the cold fluid from the first edge to the second edge, wherein:

a thermal resistance of the nonlinear coolant tube near the first edge is greater than the thermal resistance of the nonlinear coolant tube near the second edge;

the nonlinear coolant tube further comprises a plurality of coolant passages arranged in a planar array from the first edge to the second edge, wherein the cold fluid flows from a fluid supply manifold through each of the plurality of coolant passages in a parallel first direction only and then into a fluid return manifold;

each coolant passage defines a coolant passage flow area, and the flow areas of the coolant passages increases between each two adjacent coolant passages along a direction from the first edge to the second edge; and a thickness of the nonlinear coolant tube is constant from the first edge to the second edge.

2. The nonlinear coolant tube of claim 1, further comprising a plurality of coolant passages arranged in a planar array from the first edge to the second edge within the nonlinear coolant tube, wherein:

any two adjacent coolant passages define a coolant passage spacing distance; and the coolant passage spacing distance between two adjacent coolant passages near the first edge is greater than the coolant passage spacing distance between two adjacent coolant passages near the second edge.

3. The nonlinear coolant tube of claim 2, wherein the coolant passage spacing distance between each two adjacent coolant passages decreases along a direction from the first edge to the second edge.

4. The nonlinear coolant tube of claim 1, further comprising a plurality of coolant passages arranged in a planar array from the first edge to the second edge within the nonlinear coolant tube, wherein:

each coolant passage defines an interior surface profile comprising texturing, non-texturing, or both;

the interior surface profile defines a coolant passage surface texturing ratio; and the coolant passage surface texturing ratio near the first edge is less than the coolant passage surface texturing ratio near the second edge.

5. The nonlinear coolant tube of claim 4, wherein each coolant passage defines an interior surface profile comprising texturing, and the texturing comprises one or more of grooves, turbulators, and/or riblets.

6. The nonlinear coolant tube of claim 1, further comprising a plurality of coolant passages arranged in a planar array from the first edge to the second edge within the nonlinear coolant tube, wherein:

each coolant passage defines an interior surface profile defining a surface roughness height; and the coolant passage surface roughness height near the first edge is less than the coolant flow passage surface roughness height near the second edge.

7. The nonlinear coolant tube of claim 1, further comprising a plurality of coolant passages arranged in a planar array from the first edge to the second edge within the nonlinear coolant tube, wherein:

one or more of the coolant passages near the first edge includes one or more flow restriction features; and the one or more flow restriction features are configured to reduce a flowrate of cold fluid through the respective coolant passage as compared to a flowrate of the cold fluid through a coolant passage near the second edge.

8. The nonlinear coolant tube of claim 7, wherein each of the one or more flow restriction features comprise a crimp, the crimp configured to restrict flow into and/or out of the associated coolant passage.

9. The nonlinear coolant tube of claim 1, further comprising a plurality of coolant passages arranged in a planar array from the first edge to the second edge within the nonlinear coolant tube, wherein:

the heat exchanger core further comprises a coolant supply header;

the nonlinear coolant tube protrudes into the coolant supply header, defining a protrusion profile, thereby fluidly connecting each of the plurality of coolant passages to the coolant supply header;

the protrusion profile is configured so that a flowrate of the cold fluid through one or more coolant passages near the first edge is less than a flow rate of the cold fluid through one or more coolant passages near the second edge.

10. The nonlinear coolant tube of claim 1, wherein:

the heat exchanger core is a cross-flow plate-fin heat exchanger core;

the nonlinear coolant tube defines a first zone and a second zone;

the first zone is located proximate the first edge;

the second zone is downstream of the first zone relative to a direction of flow of the hot fluid through the heat exchanger core;

the first zone comprises first zone cold fins that are configured to provide a first zone cold fluid flow profile defining a first zone boundary layer;

the second zone comprises second zone cold fins that are configured to provide a second zone cold fluid flow profile defining a second zone boundary layer; and the second zone boundary layer is more disrupted than the first zone boundary layer.

11. The nonlinear coolant tube of claim 10, wherein:

the nonlinear coolant tube further comprises a third zone downstream of the second zone relative to a direction of flow of the hot fluid through the heat exchanger core; and the third zone comprises third zone cold fins that are configured to provide a third zone cold fluid flow profile defining a third zone boundary layer; and the third zone boundary layer is more disrupted than the second zone boundary layer.

12. The nonlinear coolant tube of claim 1, wherein the nonlinear coolant tube comprises a material selected from the group consisting of nickel, aluminum, titanium, copper, iron, cobalt, or alloys thereof.

13. The nonlinear coolant tube of claim 1, wherein the nonlinear coolant tube material comprises one or more polymers selected from the group consisting of polypropylene, polyethylene, polyphenylene sulfide (PPS), and polytetrafluoroethylene (PTFE).

14. The nonlinear coolant tube of claim 13, wherein the one or more polymers includes a fill material selected from the group consisting of graphite, metallic particles, carbon fibers, and carbon nanotubes.

15. The nonlinear coolant tube of claim 1, wherein the cold fluid is a liquid comprising water, glycol, or combinations thereof.

16. The nonlinear coolant tube of claim 1, wherein:

the cold fluid is a refrigerant; and the refrigerant is configured to change phase from a liquid to a gas, thereby transferring heat from the hot fluid through a latent heat of vaporization.

17. The nonlinear coolant tube of claim 1, wherein:

the hot fluid is air;

the air can comprise water vapor;

the water vapor can solidify to frost in the heat exchanger core; and the nonlinear coolant tube is configured to reduce frost accumulation near the first edge.

18. A method of reducing frost accumulation in a hot circuit of a heat exchanger core that includes a hot circuit and a cold circuit, the heat exchanger core configured to port a hot fluid therethrough and a cold fluid therethrough while maintaining isolation of the hot fluid from the cold fluid, the hot circuit defining a hot circuit inlet, a hot circuit outlet, a first edge, and a second edge, the first edge distal the second edge, the first edge proximate the hot circuit inlet and the second edge proximate the hot circuit outlet, the method comprising:

flowing the cold fluid from a fluid supply manifold into a plurality of coolant passages within a nonlinear coolant tube, wherein the plurality of coolant passages are arranged in a planar array from the first edge to the second edge; and flowing the cold fluid through each of the plurality of coolant passages into a fluid return manifold, wherein the cold fluid flowing through each of the plurality of coolant passages flows in a parallel first direction only from the fluid supply manifold to the fluid return manifold;

wherein the nonlinear coolant tube produces a non-uniform heat transfer profile between the hot fluid and the cold fluid from the first edge to the second edge and wherein a thermal resistance of the nonlinear coolant tube near the first edge is greater than the thermal resistance of the nonlinear coolant tube near the second edge;

wherein each coolant passage defines a coolant passage flow area, and the flow areas of the coolant passages increases between each two adjacent coolant passages along a direction from the first edge to the second edge; and wherein a thickness of the nonlinear coolant tube is constant from the first edge to the second edge.

* * * * *